US006675687B2

(12) United States Patent
English et al.

(10) Patent No.: US 6,675,687 B2
(45) Date of Patent: Jan. 13, 2004

(54) TIRE CUTTING MACHINE

(76) Inventors: Mark Edward English, P.O. Box 69, Chloe, WV (US) 25235; Don Maguire, Rte. 1 Box 38, Auburn, WV (US) 26325

( * ) Notice: Subject to any disclaimer, the term of this patent is extended or adjusted under 35 U.S.C. 154(b) by 189 days.

(21) Appl. No.: 10/022,052

(22) Filed: Dec. 17, 2001

(65) Prior Publication Data

US 2003/0110912 A1 Jun. 19, 2003

(51) Int. Cl.[7] ..... B26D 1/24

(52) U.S. Cl. ..... 83/500; 83/507; 83/676; 83/923; 83/951

(58) Field of Search ..... 83/425.2, 433, 83/618, 923, 951, 500, 503, 507, 663, 676, 677, 420

(56) References Cited

U.S. PATENT DOCUMENTS

| | | | | | |
|---|---|---|---|---|---|
| 4,682,522 | A | * | 7/1987 | Barclay | 83/19 |
| 5,133,236 | A | * | 7/1992 | Dudley | 83/608 |
| 5,235,888 | A | * | 8/1993 | Dom | 83/420 |
| 5,375,775 | A | * | 12/1994 | Keller et al. | 241/19 |
| 5,601,004 | A | * | 2/1997 | Queen | 82/54 |
| 6,240,819 | B1 | * | 6/2001 | Su et al. | 83/176 |

* cited by examiner

*Primary Examiner*—Allan N. Shoap
*Assistant Examiner*—Phong Nguyen

(74) *Attorney, Agent, or Firm*—Hendrickson & Long; Stephen M. Schwartz

(57) ABSTRACT

The present invention is a tire cutting machine comprising of a base, a body member, a drive assembly means and a cutting assembly means. The drive assembly means includes a drive power means simultaneously engaged to a pair of front drive wheels and to a pair of rear drive wheels to provide rotation thereof. The front drive wheels are coaxially mounted in close relation to one another on a front drive wheel shaft extending between a first drive assembly arm and a second drive assembly arm. The rear drive wheels are coaxially mounted in close relation to one another and to a guide wheel which is directly engaged to the drive power means. The cutting assembly means includes a cutting power means simultaneously engaged to a front cutting wheel and to a rear cutting wheel to provide rotation thereof. The cutting assembly means is mounted such that the lower arc of the front cutting wheel passes between the upper arcs of the front drive wheels to form a front cutting assembly and, similarly, the lower arc of the rear cutting wheel passes between the upper arcs of the rear drive wheels to form a rear cutting assembly. In operation, a scrap tire, or a portion thereof, is passed between a cutting wheel and the corresponding drive wheels thereby cutting the tire. The front cutting assembly may be used to provide transverse cuts across the tire material or the tire material may be manipulated to provide decorative cuts or various shaped portions for practical or aesthetic uses. The rear cutting assembly is used primarily to cut strips of tire material, primarily of the tread portion of a scrap tire, and includes an adjustable guide to control the width of such strips.

8 Claims, 11 Drawing Sheets

TIRE CUTTING MACHINE

CROSS REFERENCE TO RELATED DOCUMENTS

None

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

One of the most pressing and difficult environmental issues of today is the disposal of scrap rubber tires, particularly those designed for highway use on trucks and automobiles. Such tires are typically manufactured to resist road hazards and last for tens of thousands of miles. It is this propensity to longevity, however, which makes the disposal of scrap tires extremely difficult. This problem is further complicated by the overall volume of scrap tires being discarded, running into the hundreds of thousands each year.

Various attempts to dispose of scrap tires have thus far met with only limited success. Stockpiling and landfills require significant acreage and provide ideal breeding grounds and habitat for mosquitoes, snakes and other undesirable vermin. Incineration of scrap tires releases various toxic substances into the atmosphere and recycling is generally a complex process requiring significant amounts of energy and has thus far proven to be cost prohibitive. Thus, there is a need for viable alternatives for the ultimate disposal of scrap tires and therefore a corresponding need for a tire cutting machine to facilitate such alternatives.

It has heretofore been the object of the several types of tire cutting machines disclosed in the prior art to cut scrap tires into various portions thereby reducing the overall volume required for storage of the scrap tires and facilitating the handling and ultimate disposal thereof. One of the types of tire cutting machines disclosed in the prior art generally cuts, shreds or rips the scrap tires into smaller random segments. Typical of such machines are those described in U.S. Pat. No. 4,576,339 issued Mar. 18, 1986, U.S. Pat. No. 4,613,087 issued Sep. 23, 1986, and U.S. Pat. No. 5,285,707 issued Feb. 15, 1994. Another type of tire cutting machines disclosed in the prior art generally cuts the scrap tires radially resulting in transverse segments thereof. Examples of this type of machine are described in U.S. Pat. Nos. 4,338,839 and 4,338,840 both issued Jul. 13, 1982, U.S. Pat. No. 5,133,236 issued Jul. 28, 1992, U.S. Pat. No. 5,331,146 issued Jul. 2, 1996, and U.S. Pat. No. 5,551,325 issued Sep. 3, 1996. It is a disadvantage of each of these machines, however, that no further operations may be performed on the resulting segments of the scrap tire and therefore, there are only limited options for the ultimate disposal thereof.

A third type of tire cutting machine, considered to be the most relevant prior art to the present invention, generally separates the sidewall portions of a scrap tire from the tread portion by using some combination of a driving means by which to move the scrap tire into a cutting means. These type machines, however, are generally limited to performing one cut, or set of cuts, depending upon the number of cutting means, per tire. For example, the machine disclosed in U.S. Pat. No. 5,235,888 issued Aug. 17, 1993, uses two separate cutting means to simultaneously separate the sidewall portions from the tread portion of a scrap tire. Once the sidewall portions are removed from a particular scrap tire, however, no further operations may be performed with this machine and there are therefore only limited options for ultimate disposal of the resulting portions of the scrap tires. Likewise, the machine disclosed in U.S. Pat. No. 4,072,072 issued Feb. 7, 1978, uses one or more cutting means such that each scrap tire is cut axially around the tread portion thereby resulting in separated sidewall segments and, depending upon the number of separate cutting means utilized, one or more tread segments. Again, however, once a scrap tire has been passed through this machine, the resulting segments have only limited options for ultimate disposal.

Similarly, the machines disclosed in U.S. Pat. No. 3,701,296 issued Oct. 31, 1972, and in U.S. Pat. No. 5,601,004 issued Feb. 11, 1997, both utilize a pair of cutting means to separate the tread portion of a scrap tire from the sidewall portions. These machines each contain a further means to transversely cut the severed tread portions such that said tread portions may be further utilized for some secondary purpose or stacked in a flat position. It is a disadvantage of the machine of U.S. Pat. No. 3,701,296, however, in that it requires the operator to manually force the severed tread portion along a cantilevered support member to engage the transverse cutting means thereby placing the operator at risk of serious personal injury. Likewise, it is a disadvantage of the machine of U.S. Pat. No. 5,601,004 in that it utilizes a hydraulic ram and a cutting blade to shear the severed tread portion transversely, requiring significant energy and strength of machine. It is a further disadvantage of these machines that, once the tread portion is severed, it may only be cut transversely into shorter segments thereby limiting the options for which the said tread portion may be used.

Thus, there is a need for a portable, safe and versatile machine with means of cutting scrap tires into multiple segments with control over both size and shape to provide alternative options for the ultimate use and disposal of scrap tires.

BRIEF SUMMARY OF THE INVENTION

The present invention provides a machine for cutting scrap tires into numerous segments with a variety of shapes and sizes. The machine involves a base, a body member, a drive means assembly and a cutting means assembly, said cutting means assembly being vertically disposed above said drive means assembly. The drive means assembly includes a pair of front drive wheels, said front drive wheels being mounted on a front drive wheel shaft extending between a first drive assembly arm and a second drive assembly arm, and a pair of rear drive wheels. A drive power means is also included for providing rotation of the front drive wheels and the rear drive wheels. The cutting means assembly includes a front cutting wheel, said front cutting wheel being mounted on a front cutting wheel shaft extending between a first cutting assembly arm and a second cutting assembly arm, and a rear cutting wheel. A cutting power means is also included for providing rotation of the front cutting wheel and the rear cutting wheel. The cutting means assembly is positioned such that the lower arc of the front cutting wheel passes between the upper arcs of the front drive wheels to form a front cutting assembly and, similarly, the lower arc of the rear cutting wheel passes between the upper arcs fo the rear cutting wheels to form a rear cutting assembly.

In operation, a scrap tire, or a portion thereof, is passed between a cutting wheel and the corresponding drive wheels thereby cutting the tire. The front cutting assembly may be used to provide transverse cuts across the tire material or the tire material maybe manipulated to provide decorative cuts or various shaped portions for practical or aesthetic uses. The rear cutting assembly is used primarily to cut strips of tire material, primarily of the tread portion of a scrap tire, and includes an adjustable guide to control the width of such strips. Thus, it is an advantage of the present invention that material from a single scrap tire may be cut into a variety of shapes and thereby maximizing the use of the scrap tire material. Other features and advantages of the present invention are provided in the detailed description of the invention below.

DETAILED DESCRIPTION OF THE INVENTION

Figure 1:
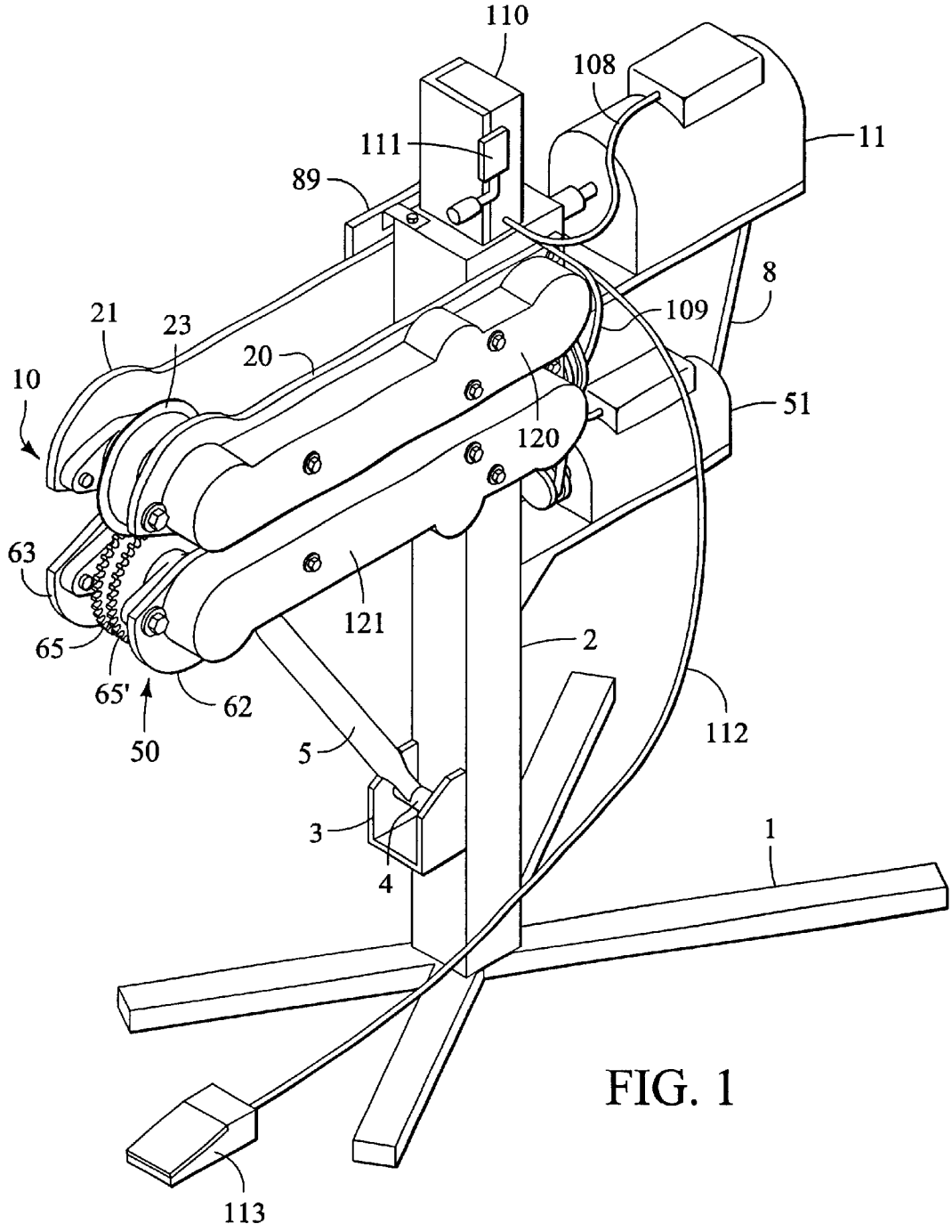
FIG. 1 is a first side perspective view of the tire cutting machine of the present invention.

Referring to FIG. 1, the tire cutting machine of the present invention includes a base member 1 and an upwardly extending body member 2. Attached to and supported by said body member 2 is drive means assembly 50 having a first side and an opposite second side. Vertically disposed above drive means assembly 50 is cutting means assembly 10 having a first side and an opposite second side. Vertically disposed above cutting means assembly 10 is control box 110 with main on/off switch 111, said control box 110 being connected to foot switch 113 by control lead 112.

Figure 2:
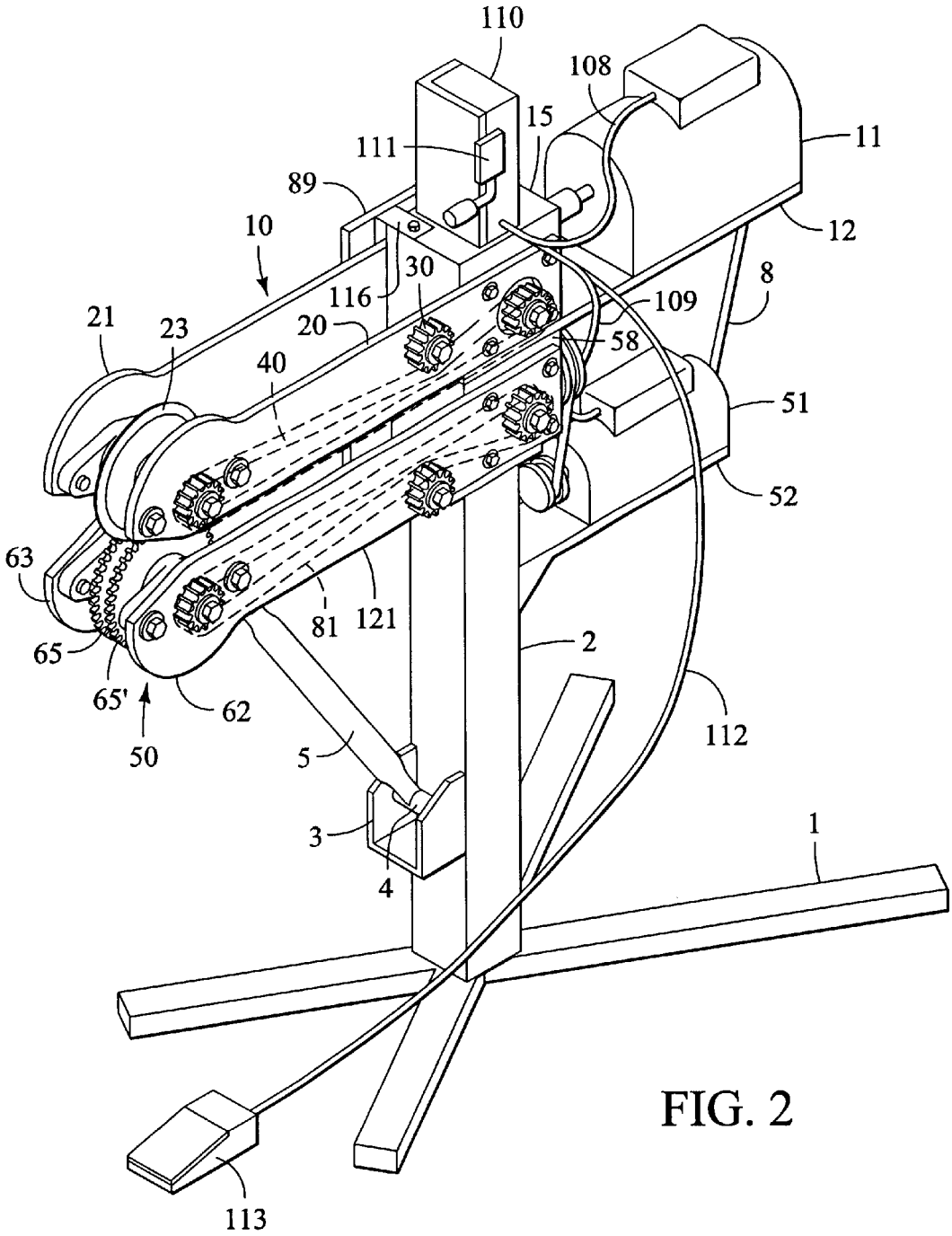
FIG. 2 is a first side perspective view of the tire cutting machine showing the drive mechanism for the front cutting area.
Figure 3:
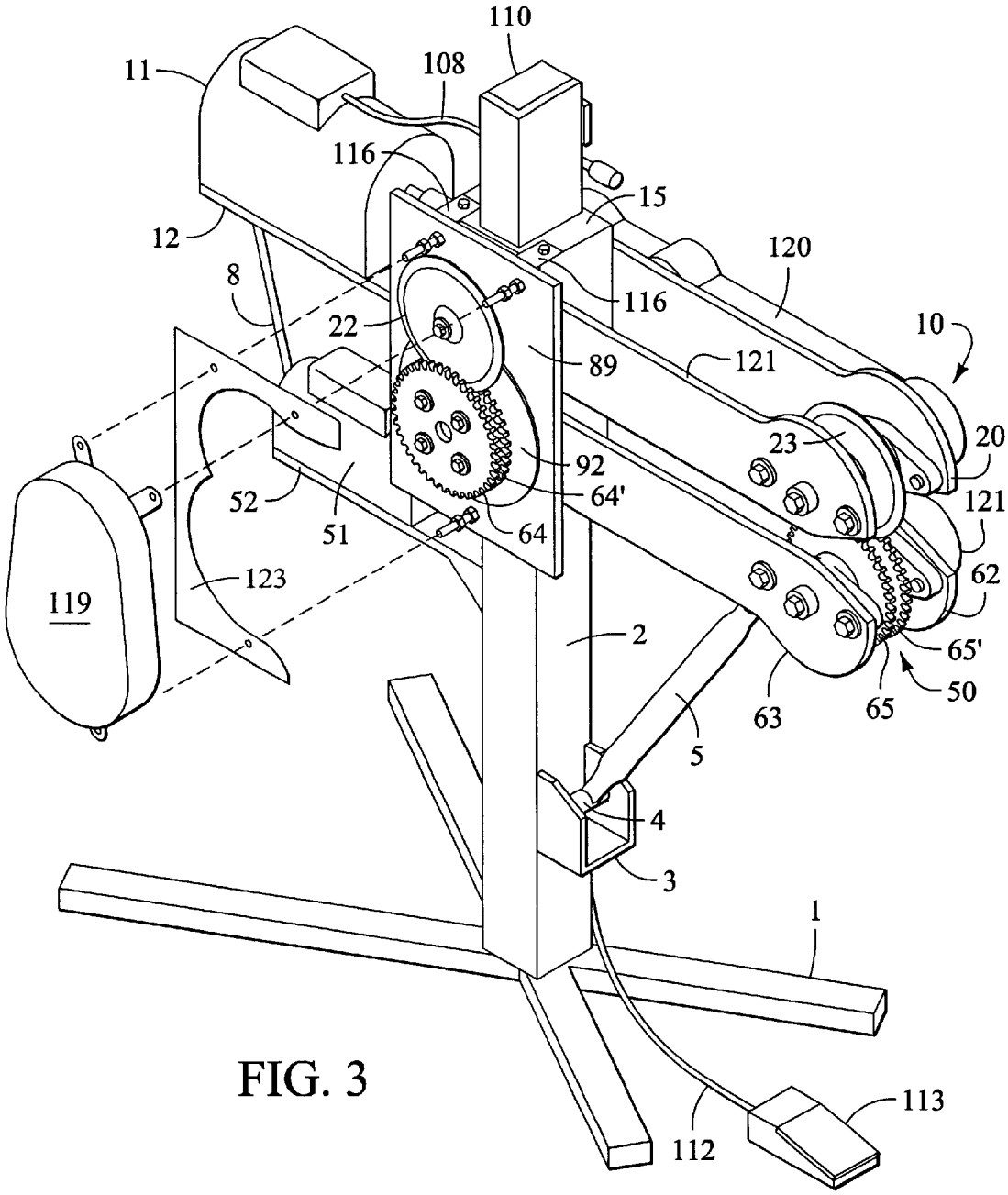
FIG. 3 is a second side perspective view of the tire cutting machine showing the rear cutting area.

As detailed most clearly in FIG. 2 and FIG. 3 showing, respectively, a first and second perspective view of the tire cutting machine, drive means assembly 50 generally includes drive motor 51, drive gear reduction means 58 having a first side and an opposite second side, a first drive assembly arm 62 and a second drive assembly arm 63, a pair of rear drive wheels 64 and 64' and a pair of front drive wheels 65 and 65'. Likewise, cutting assembly means 10 generally includes cutting motor 11, cutting gear reduction means 15 having a first side and an opposite second side, a first cutting assembly arm 20 and a second cutting assembly arm 21, a rear cutting wheel 22 and a front cutting wheel 23.

Figure 4:
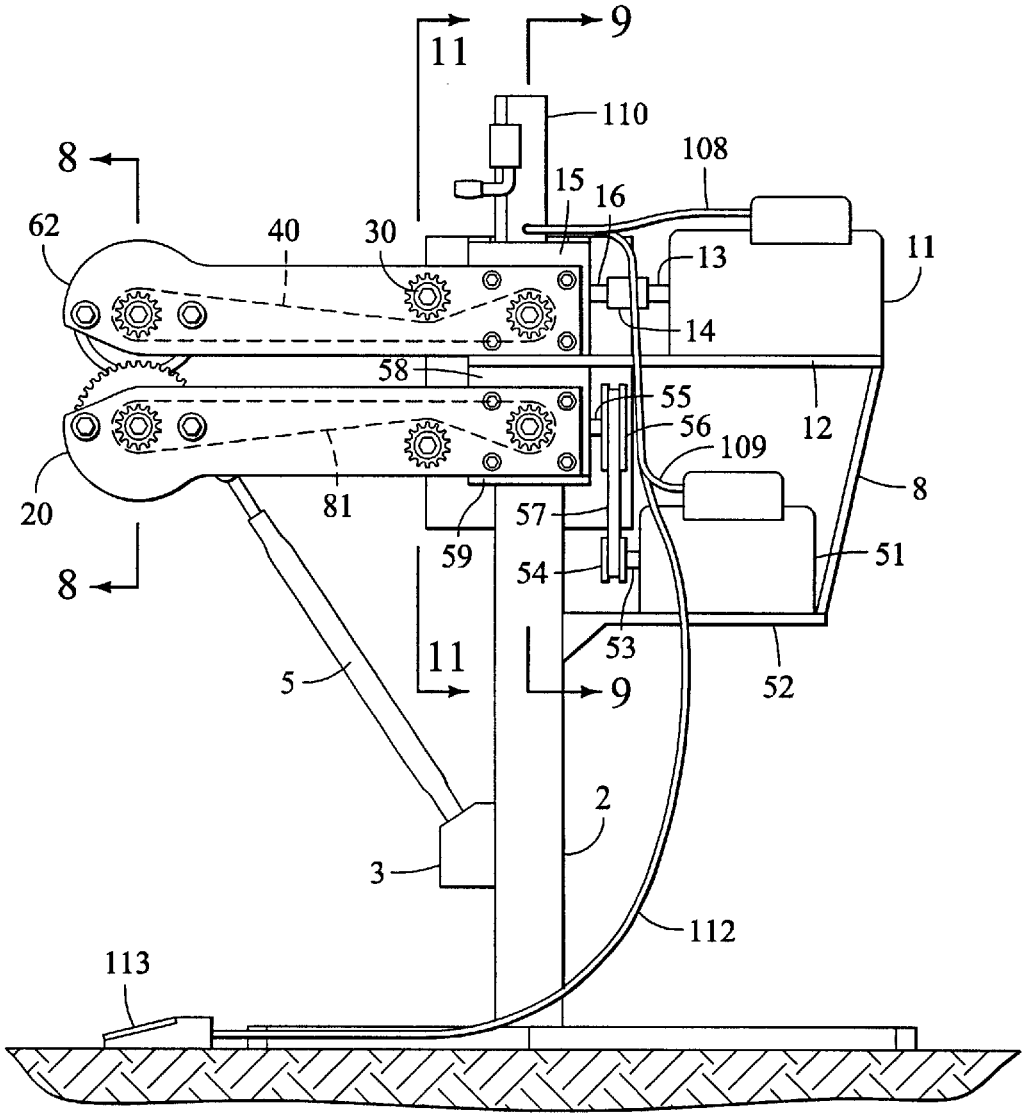
FIG. 4 is a side view of the first side of the tire cutting machine.

Referring to FIG. 4 showing a side view of the first side of the tire cutting machine, drive motor 51, which includes rotatable drive motor output shaft 53, is mounted on drive motor support means 52, said drive motor support means 52 being attached to body member 2. Drive gear reduction means 58, which includes rotatable drive gear reduction input shaft 55, is mounted on drive means assembly support plate 59, said drive means assembly support plate 59 being mounted on body member 2. Drive motor power lead 109 extends from control box 110 to drive motor 51. In the preferred embodiment, first pulley 54 is mounted on drive motor output shaft 53 by means of a key and keyway, setscrew or other similar locking mechanism (not shown). Similarly, second pulley 56 is mounted on drive gear reduction input shaft 55 by means of a key and keyway, setscrew or other similar locking mechanism (not shown), said second pulley 56 being aligned with first pulley 54. Rotational force is transmitted from first pulley 54 to second pulley 56 by means of belt 57.

Figure 8:
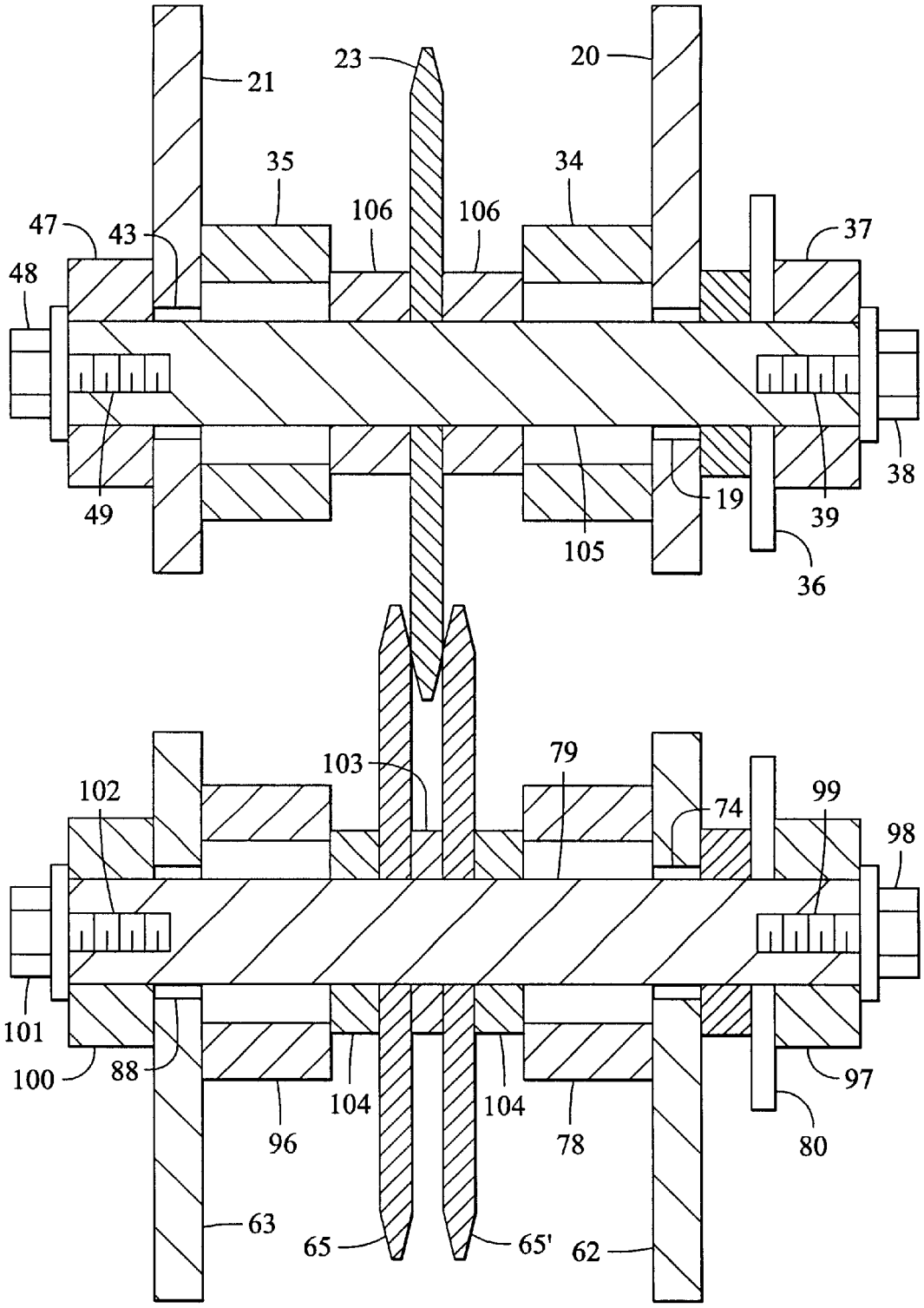
FIG. 8 is a sectional view of the front cutting assembly.
Figure 9:
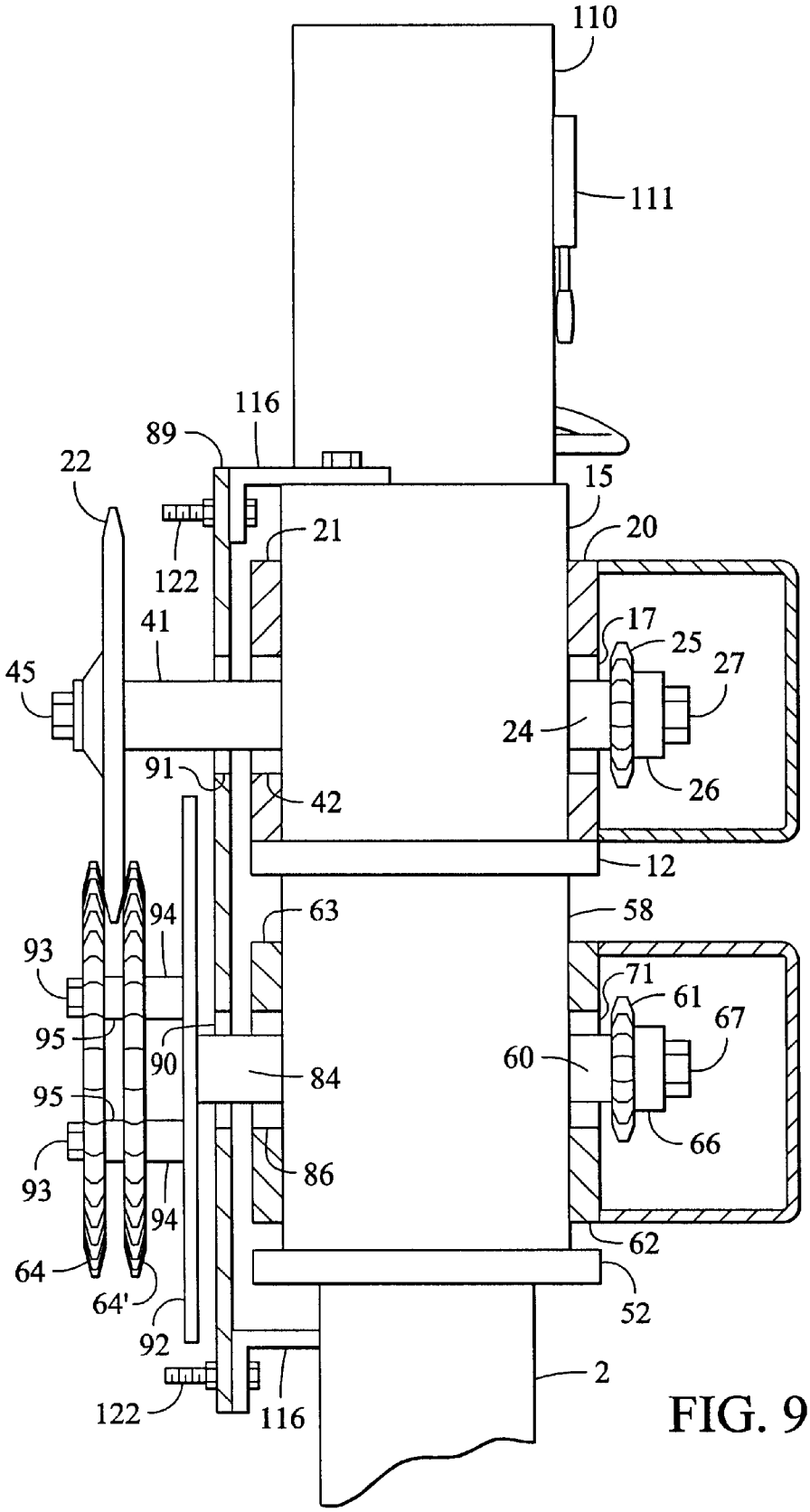
FIG. 9 is a sectional view of the rear cutting assembly.
Figure 10:
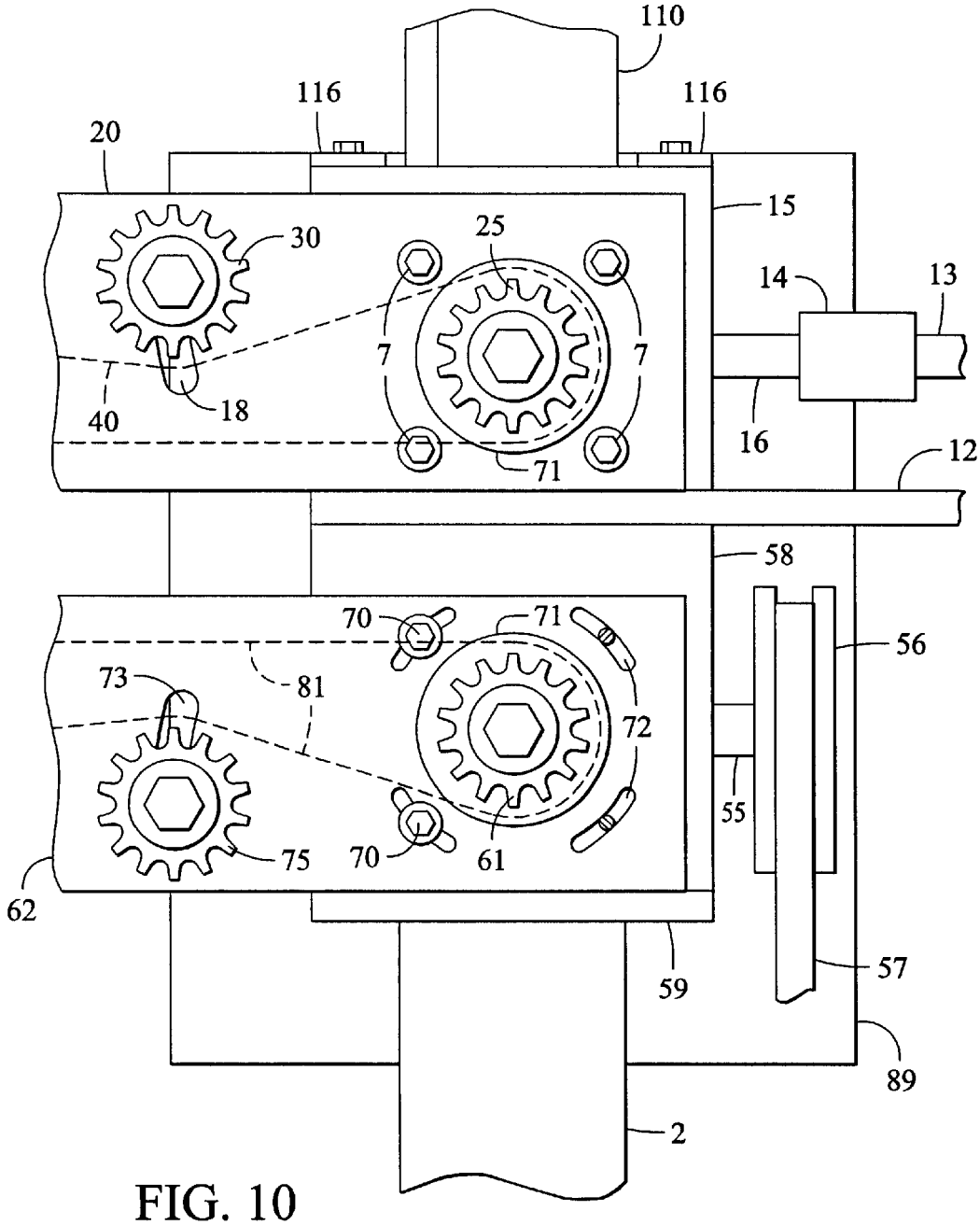
FIG. 10 is a detail side view of the rear portion of the first drive arm and the first cutting arm.
Figure 11:
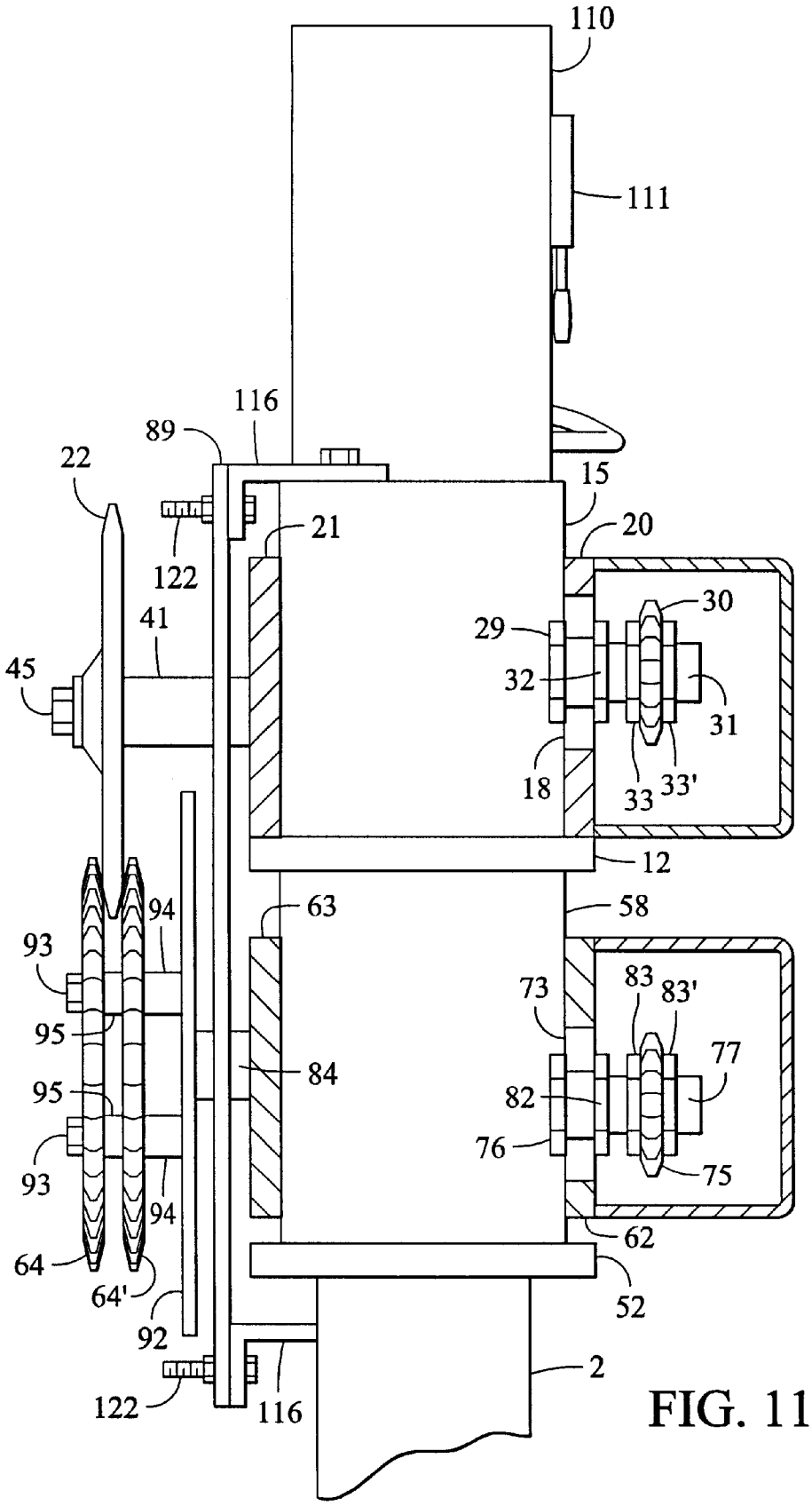
FIG. 11 is a sectional view of the drive chain tension means.

As detailed most clearly in FIG. 10, mounted on the first side of said drive gear reduction means 58 by means of a plurality of mounting bolts 70 is first drive assembly arm 62 having an outside portion and an opposite inside portion, said first drive assembly arm 62 extending horizontally toward the front of the tire cutting machine. First drive assembly arm 62 includes a first aperture 71, a second aperture 74, a slotted aperture 73 and a plurality of slotted mounting apertures 72. As detailed most clearly in FIG. 9, extending horizontally from the first side of drive gear reduction means 58 to an outside end is rotatable first drive gear reduction output shaft 60, said first drive gear reduction output shaft 60 having threaded aperture 68 extending coaxially into the outside end thereof. First aperture 71 is configured such that first drive gear reduction output shaft 60 may pass freely therethrough. First drive sprocket 61 is mounted on said first drive gear reduction output shaft 60 by means of a key and keyway, setscrew or other similar locking mechanism (not shown), said first drive sprocket 61 being positioned adjacent to the outside portion of first drive assembly arm 62. In the preferred embodiment, lateral alignment of first drive sprocket 61 on first drive gear reduction output shaft 60 is maintained by set collar 66 and lock bolt 67, said lock bolt 67 being engaged in threaded aperture 68. As detailed most clearly in FIG. 11, drive tension sprocket 75 is mounted on drive tension shaft 77, said drive tension shaft 77 having a first end and an opposite second end. The first end of drive tension shaft 77 passes freely through slotted aperture 73 and is held in position by means of bolt head or nut 76 positioned on said first end of drive tension shaft 77 adjacent to the inside portion of first drive assembly arm 62 and drive tension assembly lock nut 82 positioned on said drive tension shaft 77 adjacent to the outside portion of first drive assembly arm 62. Drive tension sprocket 75 is positioned near the second end of drive tension shaft 77 and held in lateral alignment with first drive sprocket 61 by means of a pair of sprocket lock nuts 83 and 83'. In the preferred embodiment, drive tension sprocket 75 includes an integral roller or ball bearing feature (not shown) known to those skilled in the art to allow free rotation of drive tension sprocket 75 on drive tension shaft 77 with drive tension shaft 77 being held in a fixed position relative to first drive assembly arm 62. Referring next to FIG. 8, mounted on the inside portion of first drive assembly arm 62 adjacent to second aperture 74 is first drive bearing 78. Drive wheel shaft 79 is rotatably mounted in first drive bearing 78, said drive wheel shaft 79 having a first end and an opposite second end. Second aperture 74 is configured such that drive wheel shaft 79 may pass freely therethrough. Second drive sprocket 80 is mounted on said drive wheel shaft 79 by means of a key and keyway, setscrew or other similar locking mechanism (not shown), said second drive sprocket 80 being positioned adjacent to the outside portion of first drive assembly arm 62 and in lateral alignment with first drive sprocket 61 and drive tension sprocket 75. Rotational force is transmitted from first drive sprocket 61 to second drive sprocket 80 by means of drive assembly chain 81. In the preferred embodiment of the present invention, drive tension sprocket 75 is engaged to drive assembly chain 81 by loosening drive tension assembly lock nut 82 and moving drive tension shaft 77 along slotted aperture 73 until drive tension sprocket 75 forces drive assembly chain 81 into the desired tension. Drive tension assembly lock nut 82 may then be tightened to maintain such desired tension in drive assembly chain 81 during operation although those skilled in the art will recognize that other tensioning means may be likewise employed.

Figure 5:
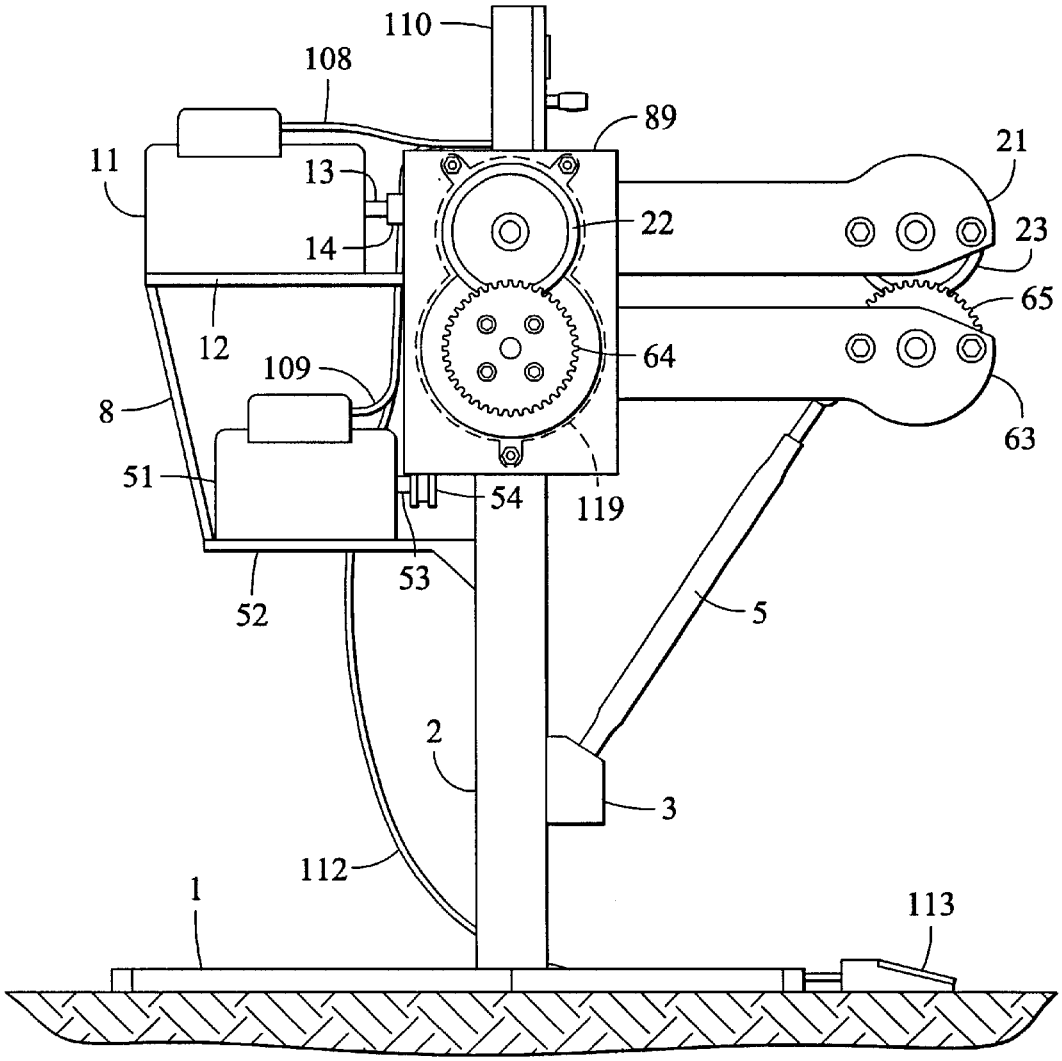
FIG. 5 is a side view of the second side of the tire cutting machine.
Figure 6:
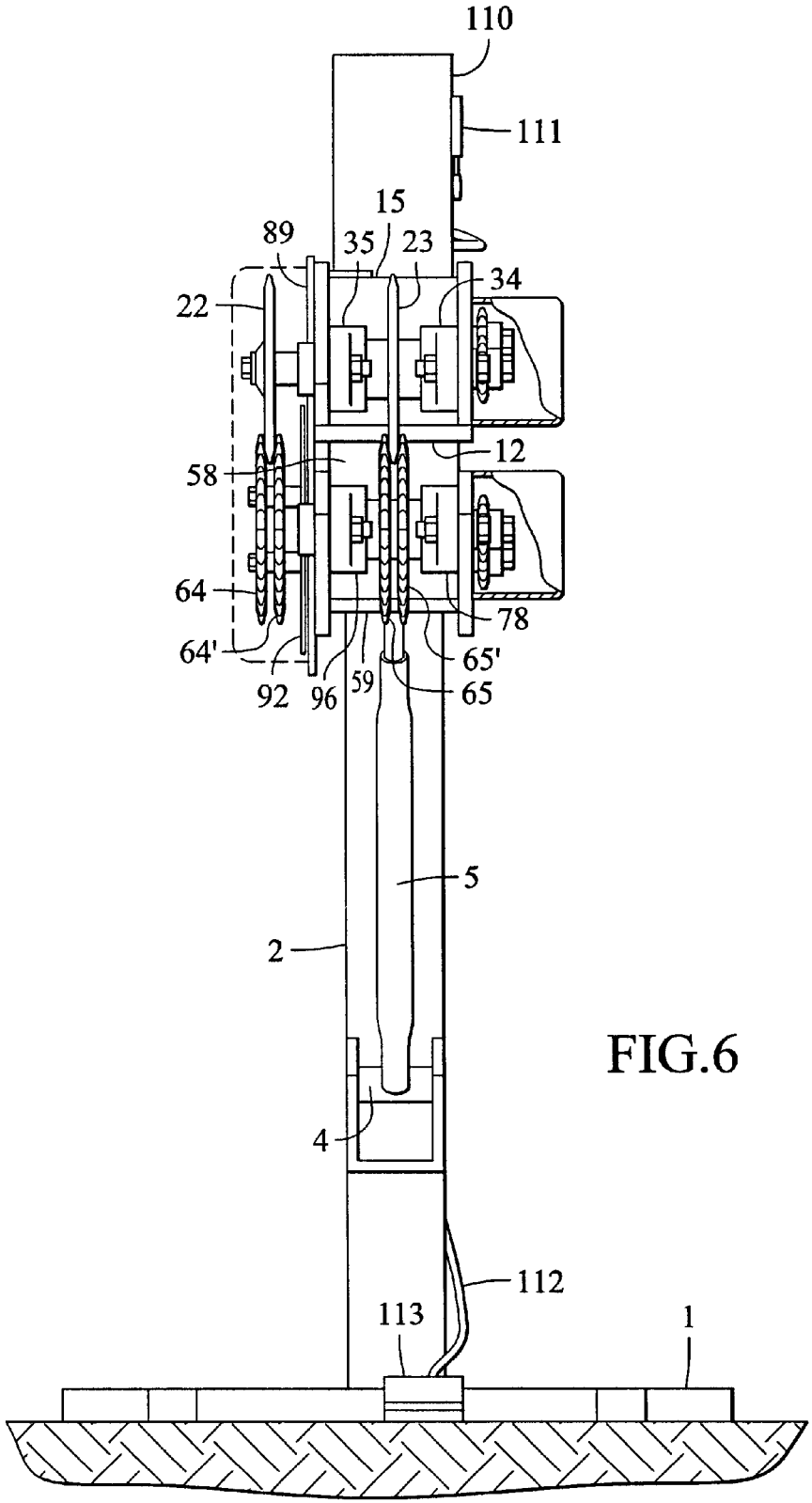
FIG. 6 is a 1 front view of the tire cutting machine.
Figure 7:
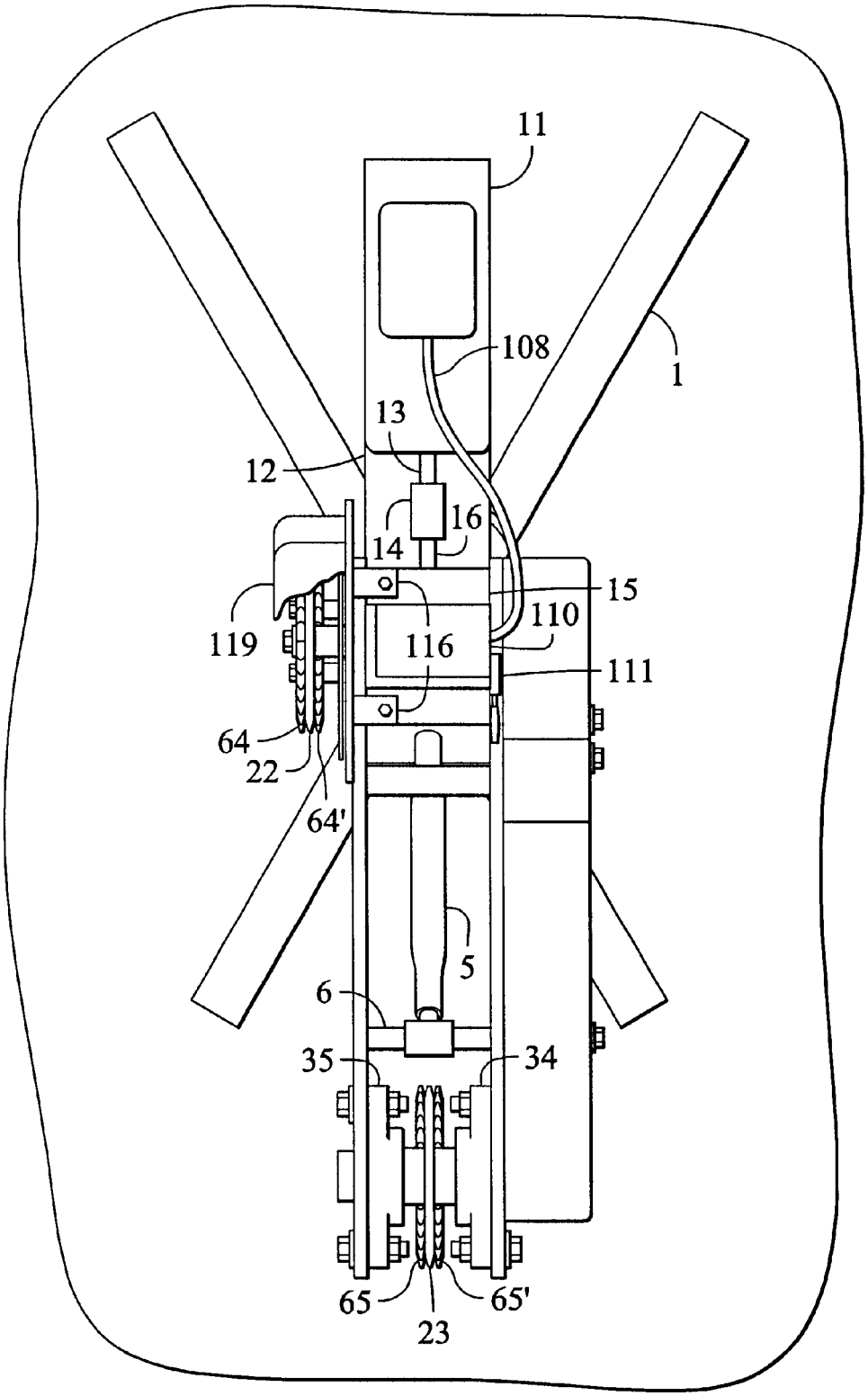
FIG. 7 is a top view of the tire cutting machine.

Referring next to FIG. 5 showing a side view of the second side of the tire cutting machine, drive means assembly 50 further includes second drive assembly arm 63 having an outside portion and an opposite inside portion, said second drive assembly arm 63 extending horizontally toward the front of the tire cutting machine and being opposite and in colinear relation to first drive assembly arm 62. Second drive assembly arm 63 includes a first aperture 86, a second aperture 88 and a plurality of slotted mounting apertures 87. Similar to as shown in FIG. 10, second drive assembly arm 63 is mounted on the second side of said drive gear reduction means 58 by means of a plurality of mounting bolts 85 extending through slotted mounting apertures 87. Mounted adjacent to the outside portion of second drive assembly arm 63 by means of a plurality of shield plate mounting brackets 116 is shield plate 89, said shield plate 89 having a first aperture 90 and a second aperture 91. Extending horizontally from the second side of drive gear reduction means 58 to an outside end is rotatable second drive gear reduction output shaft 84. First aperture 86 of second drive assembly arm 63 and first aperture 90 of shield plate 89 are configured such that second drive gear reduction output shaft 84 may simultaneously pass freely therethrough. As detailed most clearly in FIG. 9, guide wheel 92 is fixably mounted to second drive gear reduction output shaft 84 substantially near the outside end thereof and adjacent to shield plate 89 on the opposite side from second drive assembly arm 63, said guide wheel 92 having a face on the opposite side from that portion being adjacent to shield plate 89. Mounted on the face of guide wheel 92 is a plurality of spacer bolts 93 which extend outward a sufficient distance to engage rear drive wheels 64 and 64'. In the preferred embodiment, rear drive wheels 64 and 64' each include serrated edges and a plurality of apertures configured to receive spacer bolts 93. Positioned coaxially around each spacer bolt 93 is a strip spacer 94 and a wheel spacer 95, said strip spacers 94 being positioned between rear drive wheel 64' and guide wheel 92 and said wheel spacers 95 being positioned between rear drive wheels 64 and 64'. Spacer bolts 93 are tightened to secure and lock guide wheel 92 and cutting wheels 64 and 64' in the desired position relative to one another as defined by strip spacers 94 and wheel spacers 95 by using any combination of bolts, nuts and/or threaded apertures obvious and known to those skilled in the art. Mounted on the inside portion of second drive assembly arm 63 adjacent to second aperture 88 is second drive bearing 96. Drive wheel shaft 79 is further rotatably mounted in second drive bearing 96. Second aperture 88 is configured such that drive wheel shaft 79 may pass freely therethrough.

As detailed must clearly in FIG. 8, in addition to second drive sprocket 80 previously described, centrally mounted on drive wheel shaft 79 between first drive bearing 78 and second drive bearing 96 are front drive wheels 65 and 65', said front drive wheels 65 and 65' being mounted on said drive wheel shaft 79 by means of a key and keyway, setscrew or other similar locking mechanism (not shown). In the preferred embodiment, front drive wheels 65 and 65' each include serrated edges. Lateral alignment of second drive sprocket 80 and front drive wheels 65 and 65' on drive wheel shaft 79 is maintained by means of set collar 97 and lock bolt 98, said lock bolt 98 being engaged in threaded aperture 99 which extends coaxially into the first end of drive wheel shaft 79 and set collar 100 and lock bolt 101, said lock bolt 101 being engaged in threaded aperture 102 which extends coaxially into the second end of drive wheel shaft 79. Spacing along drive wheel shaft 79 is maintained by means of wheel spacers 103 positioned between front drive wheels 65 and 65' and a plurality of alignment spacers 104.

Referring again to FIG. 2 and FIG. 3, bracket 3 is mounted to body member 2 a sufficient distance below drive means assembly 50, said bracket 3 including lower pin 4. Mounted between first drive assembly arm 62 and second drive assembly arm 63 of drive means assembly 50 is upper pin 6. Adjustable brace 5, which may be a turnbuckle or the like, extends between lower pin 4 and upper pin 6 and is movably mounted to said lower pin 4 and upper pin 6 such that, when first drive arm mounting bolts 70 and second drive arm mounting bolts 85 are loosened, the relative position of front drive wheels 65 and 65' to front cutting wheel 23 maybe adjusted by lengthening or shortening adjustable brace 5 thereby raising or lowering the front portion of drive means assembly 50 by rotating first drive assembly arm 62 and second drive assembly arm 63, in unison with one another, along slotted mounting apertures 72 and slotted mounting apertures 87 respectively. When front drive wheels 65 and 65' are in the desired position relative to front cutting wheel 23, first drive arm mounting bolts 70 and second drive arm mounting bolts 85 may be tightened.

Referring once again to FIG. 4 showing a side view of the first side of the tire cutting machine, cutting means assembly 10 is vertically disposed above drive means assembly 50 with cutting motor 11 and cutting gear reduction means 15 being mounted on cutting means assembly support plate 12, said cutting means assembly support plate 12 being mounted on drive gear reduction means 58. Cutting means assembly 10 is further supported by brace 8 extending between cutting means assembly support plate 12 and drive means assembly support plate 59. Cutting motor power lead 108 extends from control box 110 to cutting motor 11. Cutting motor 11 includes rotatable cutting motor output shaft 13 and cutting gear reduction means 15 includes rotatable cutting gear reduction means input shaft 16. In the preferred embodiment, cutting motor output shaft 13 is fixably connected to cutting gear reduction means input shaft 16 by coupling 14.

As detailed most clearly in FIG. 10, mounted on the first side of said cutting gear reduction means 15 by means of a plurality of mounting bolts 7 is first cutting assembly arm 20 having an outside portion and an opposite inside portion, said first cutting assembly arm 20 extending horizontally toward the front of the tire cutting machine in parallel relation to first drive assembly arm 62 and second drive assembly arm 63. First cutting assembly arm 20 includes a first aperture 17, a slotted aperture 18 and a second aperture 19. As detailed most clearly in FIG. 9, extending horizontally from the first side of cutting gear reduction means 15 to an outside end is rotatable first cutting gear reduction output shaft 24, said first cutting gear reduction output shaft 24 having threaded aperture 28 extending coaxially into the outside end thereof. First aperture 17 is configured such that first cutting gear reduction output shaft 24 may pass freely therethrough. First cutting sprocket 25 is mounted on said first cutting gear reduction output shaft 24 by means of a key and keyway, setscrew or other similar locking mechanism (not shown), said first cutting sprocket 25 being positioned adjacent to the outside portion of first cutting assembly arm 20. In the preferred embodiment, lateral alignment of first cutting sprocket 25 on first cutting gear reduction output shaft 24 is maintained by set collar 26 and lock bolt 27, said lock bolt 27 being engaged in threaded aperture 28. As detailed most clearly in FIG. 11, cutting tension sprocket 30 is mounted adjacent to slotted aperture 18 by means of cutting tension shaft 31, said cutting tension shaft 31 having a first end and an opposite second end. The first end of cutting tension shaft 31 passes freely through slotted aperture 18 and is held in position by means of bolt head or nut 29 positioned on said first end of cutting tension shaft 31 adjacent to the inside portion of first cutting assembly arm 20 and cutting tension assembly lock nut 32 positioned on said cutting tension shaft 31 adjacent to the outside portion of first cutting assembly arm 20. Cutting tension sprocket 30 is positioned near the second end of cutting tension shaft 31 and held in lateral alignment with first cutting sprocket 25 by means of a pair of cutting sprocket lock nuts 33 and 33'. In the preferred embodiment, cutting tension sprocket 30 includes an integral roller or ball bearing feature (not shown) known to those skilled in the art to allow free rotation of cutting tension sprocket 30 on cutting tension shaft 31 with cutting tension shaft 31 being held in a fixed position relative to first cutting assembly arm 20. Referring again to FIG. 8, mounted on the inside portion of first cutting assembly arm 20 adjacent to second aperture 19 is first cutting bearing 34. Cutting wheel shaft 105 is rotatably mounted in first cutting bearing 34, said cutting wheel shaft 105 having a first end and an opposite second end. Second aperture 19 is configured such that cutting wheel shaft 105 may pass freely therethrough. Second cutting sprocket 36 is mounted on said cutting wheel shaft 105 by means of a key and keyway, setscrew or other similar locking mechanism (not shown), said second cutting sprocket 36 being positioned adjacent to the outside portion of first cutting assembly arm 20 and in lateral alignment with first cutting sprocket 25 and cutting tension sprocket 30. Rotational force is transmitted from first cutting sprocket 25 to second cutting sprocket 36 by means of cutting assembly chain 40. In the preferred embodiment of the present invention, cutting tension sprocket 30 is engaged to cutting assembly chain 40 by loosening cutting tension assembly lock nut 32 and moving cutting tension shaft 31 along slotted aperture 18 until cutting tension sprocket 30 forces cutting assembly chain 40 into the desired tension. Cutting tension assembly lock nut 32 may then be tightened to maintain such desired tension in cutting assembly chain 40 during operation although those skilled in the art will recognize that other tensioning means may be likewise employed.

Referring again to FIG. 5 showing a side view of the second side of the tire cutting machine, mounted on the second side of cutting gear reduction means 15 by means of a plurality of mounting bolts 9 is second cutting assembly arm 21 having an outside portion and an opposite inside portion, said second cutting assembly arm 21 extending horizontally toward the front of the tire cutting machine and being opposite and in colinear relation to first cutting assembly arm 20. Second cutting assembly arm 21 includes a first aperture 42 and a second aperture 43. Similar to as shown in FIG. 10, second cutting assembly arm 21 is mounted on the second side of said cutting gear reduction means 15. Extending horizontally from the second side of cutting gear reduction means 15 to an outside end is rotatable second cutting gear reduction output shaft 41. As detailed most clearly in FIG. 9, shield plate 89 previously described extends upward adjacent to the outside portion of second cutting assembly arm 21. First aperture 42 of second cutting assembly arm 21 and second aperture 91 of shield plate 89 are configured such that second cutting gear reduction output shaft 41 may simultaneously pass freely therethrough. Rear cutting wheel 22 is mounted to second cutting gear reduction output shaft 41 substantially near the outside end thereof by means of a key and keyway, setscrew or other similar locking mechanism (not shown). Lateral alignment of rear cutting wheel 22 on second cutting gear reduction output shaft 41 is maintained by means of set collar 44 and lock bolt 45, said lock bolt 45 being engaged in threaded aperture 46 which extends coaxially into the outside end of second cutting gear reduction output shaft 41. Rear cutting wheel 22 and rear drive wheels 64 and 64' are sized and relatively positioned such that the lower arc of rear cutting wheel 22 passes between the upper arc of rear drive wheels 64 and 64'. Mounted on the inside portion of second cutting assembly arm 21 adjacent to second aperture 43 is second cutting bearing 35. Cutting wheel shaft 105 is further rotatably mounted in second cutting bearing 35. Second aperture 43 is configured such that cutting wheel shaft 105 may pass freely therethrough.

As detailed must clearly in FIG. 8, in addition to second cutting sprocket 36 previously described, centrally mounted on cutting wheel shaft 105 between first cutting bearing 34 and second cutting bearing 35 is front cutting wheel 23, said front cutting wheel 23 being mounted on said cutting wheel shaft 105 by means of a key and keyway, setscrew or other similar locking mechanism (not shown). Lateral alignment of second cutting sprocket 36 and front cutting wheel 23 on cutting wheel shaft 105 is maintained by means of set collar 37 and lock bolt 38, said lock bolt 38 being engaged in threaded aperture 39 which extends coaxially into the first end of cutting wheel shaft 105 and set collar 47 and lock bolt 48, said lock bolt 48 being engaged in threaded aperture 49 which extends coaxially into the second end of cutting wheel shaft 105. Spacing along cutting wheel shaft 105 is maintained by means of alignment spacers 106. Front cutting wheel 23 and front drive wheels 65 and 65' are sized and relatively positioned such that the lower arc of front cutting wheel 23 passes between the upper arc of front drive wheels 65 and 65'.

In the preferred embodiment of the present invention, first pulley 54 and second pulley 56 of drive means assembly 50 are sized such to provide approximately a two-to-one reduction ratio therebetween. Likewise, drive gear reduction means 58 provides a further reduction of approximately sixty-to-one between drive gear reduction input shaft 55 and first and second drive gear reduction output shafts 60 and 84. Similarly, cutting gear reduction means 15 provides a reduction of approximately twenty-to-one between cutting gear reduction input shaft 16 and first and second cutting gear reduction output shafts 24 and 41. While these ratios are provided as the preferred embodiment of the present invention, those skilled in the art will recognize that these ratios may be varied without changing the nature and concept of the present invention.

Other improvements to the present invention include cutting chain guard 120 and drive chain guard 121 mounted around cutting assembly chain 40 and drive assembly chain 81, respectively, to increase the safety of the tire cutting machine. Similarly, rear guard 119 is mounted by a plurality of rear guard mounting bolts 122 to shield plate 89 such that said rear guard 119 surrounds rear cutting wheel 22 and rear drive wheels 64 and 641. In the preferred embodiment, rear guard 119 may be removed and width guide plate 123 installed on rear guard mounting bolts 122. Width guide plate 123 may be adjusted laterally relative to rear cutting wheel 22 and locked in position by a pair of width guide plate lock nuts 124 mounted on each rear guard mounting bolt 122, said width guide plate lock nuts 124 being positioned one on either side of width guide plate 123.

In operation, the operator places the main on/off switch 111 in the "on" position thereby starting the rotation of rear cutting wheel 22 and front cutting wheel 23. The rotation of rear drive wheels 64 and 64' and front drive wheels 65 and 65' may then be started and stopped by alternately depressing and releasing, respectively, foot switch 113. With main on/off switch 111 in the "on" position, the operator may move a scrap tire, with or without the sidewall previously removed, into the cutting area formed between front cutting wheel 23 and front drive wheels 65 and 65'. The operator then engages front drive wheels 65 and 65' by depressing foot switch 113 thereby pulling the scrap tire into said cutting area and cutting said scrap tire into segments. Similarly, with rear guard 119 removed, the operator may move a scrap tire segment which has been previously bisected into the cutting area formed between rear cutting wheel 22 and rear drive wheels 64 and 64'. The operator then engages the rear drive wheels 64 and 64' by depressing foot switch 113 thereby pulling the scrap tire segment into said cutting area and further cutting said scrap tire segment into strips. In the event the desired width of the scrap tire strip is less than the distance between rear cutting wheel 22 and guide wheel 92 as previously described, width guide plate 123 may be installed at the desired position such that distance between rear cutting wheel 22 and width guide plate 123 is equal to the desired width of the scrap tire strip. In addition, the operator may move previously cut scrap tire segments or strips into the cutting area formed between front cutting wheel 23 and front drive wheels 65 and 65', using a combination of moving the scrap tire segment and engaging and disengaging front drive wheels 65 and 65' by means of foot switch 113 to obtain a variety of shapes and sizes of scrap tire segments. Thus, the scrap tire cutting machine of the present invention allows the operator to cut a scrap tire into a variety of shapes and sizes which may then be further processed, stored or used for any number of purposes thereby facilitating the ultimate use and disposal of scrap tires.

What is claimed is:

1. A tire cutting machine comprising:

(a) a base;

(b) a body member mounted on said base;

(c) a drive means assembly mounted on said body member, said drive means assembly having a drive power means, a first drive assembly arm and a second drive assembly arm mounted in colinear relation one to another, a pair of front drive wheels each having an upper arc, said front drive wheels being mounted in a close side-by-side relation on a front drive wheel shaft and positioned between said first drive assembly arm and said second drive assembly arm, a pair of rear drive wheels each having an upper arc, said rear drive wheels being mounted in a close side-by-side relation coaxially to a guide wheel a predetermined distance therefrom, said guide wheel being mounted and engaged to said drive power means with said drive power means being further engaged to said pair of front drive wheels to provide simultaneous rotation of said pair of front drive wheels and said pair of rear drive wheels and said guide wheel; and (d) a cutting means assembly having a cutting power means, a first cutting assembly arm and a second cutting assembly arm mounted in colinear relation one to another, a front cutting wheel having a lower arc, said front cutting wheel being mounted on a front cutting wheel shaft and positioned between said first cutting assembly arm and said second cutting assembly arm, a rear cutting wheel having a lower arc, said rear cutting wheel being mounted and engaged to said cutting power means with said cutting power means being further engaged to said front cutting wheel to provide simultaneous rotation of said front cutting wheel and said rear cutting wheel, said cutting means assembly being vertically disposed above said drive means assembly and positioned with the lower arc of said front cutting wheel passing between the upper arcs of said pair of front drive wheels and the lower arc of said rear cutting wheel passing between the upper arcs of said pair of rear drive wheels such that a tire or tire segment being engaged to said front drive wheels is forced into a positive engagement with said front cutting wheel to impart a cutting force to said tire or tire segment and, similarly, a previously severed tread portion of a tire, said tread portion having been further transversely severed to form a strip, being engaged to said rear drive wheels such that said tread portion is forced into a positive engagement with said rear cutting wheel to impart a cutting force to said tread portion to divide said tread portion into strips of a width defined by the predetermined distance between said rear drive wheels and said guide wheel.

2. A tire cutting machine as recited in claim 1, wherein said front drive wheels and said rear drive wheels each include serrated edges.

3. A tire cutting machine as recited in claim 1, wherein said first drive assembly arm and said second drive assembly arm are pivotally mounted, further comprising an upper pin extending between said first drive assembly arm and said second drive assembly arm, a lower pin mounted on said body member and an adjustable brace extending between said upper pin and said lower pin such that the position of said front drive wheels may be adjusted vertically relative to said front cutting wheel by adjusting the length of said brace to simultaneously raise or lower the front ends of said first drive assembly arm and said second drive assembly arm thereby decreasing or increasing the lower arc of said front cutting wheel which passes between the upper arcs of said front drive wheels to allow for various thicknesses of tires or tire segments.

4. A tire cutting machine as recited in claim 1, wherein:

(a) said drive power means includes a drive motor, a drive gear reduction means, means to couple said drive gear reduction means to said drive motor, said drive gear reduction means having a first drive output shaft and an opposite second drive output shaft with said guide wheel being mounted on said second drive output shaft, a front drive wheel shaft with said front drive wheels being mounted on said front drive wheel shaft, means to transmit rotational force between said first drive output shaft and said front drive wheel shaft, and (b) said cutting power means includes a cutting motor, a cutting gear reduction means coupled to said cutting motor, said cutting gear reduction means having a first cutting output shaft and an opposite second cutting output shaft with said rear cutting wheel being mounted on said second cutting output shaft, a front cutting wheel shaft with said front cutting wheel being mounted on said front cutting wheel shaft and means to transmit rotational force between said first cutting output shaft and said front cutting wheel shaft.

5. A tire cutting machine as recited in claim 4, wherein said means to couple said drive gear reduction means to said drive motor includes a drive motor output shaft, a first pulley mounted on said drive motor output shaft, a drive gear reduction input shaft, a second pulley mounted on said drive gear reduction input shaft and a continuous belt extending around said first pulley and said second pulley.

6. A tire cutting machine as recited in claim 4, wherein:

(a) said means to transmit rotational force between said first drive output shaft and said front drive wheel shaft includes a first drive sprocket mounted on said first drive output shaft, a second drive sprocket mounted on said front drive wheel shaft, a first drive chain extending around said first drive sprocket and said second drive sprocket, and (b) said means to transmit rotational force between said first cutting output shaft and said front cutting wheel shaft includes a first cutting sprocket mounted on said first cutting output shaft, a second cutting sprocket mounted on said front cutting wheel shaft and a second drive chain extending around said first cutting sprocket and said second cutting sprocket.

7. A tire cutting machine as recited in claim 6, further comprising a drive tension sprocket adjustably mounted on said first drive assembly arm, said drive tension sprocket being engaged to said first drive chain and a cutting tension sprocket adjustably mounted on said first cutting assembly arm, said cutting tension sprocket being engaged to said second drive chain.

8. A tire cutting machine as recited in claim 1, further comprising a foot switch connected to said drive power means such that said foot switch can engage and disengage said drive power means thereby starting and stopping the rotation of said front drive wheels and said rear drive wheels.

* * * * *